US009321163B2

(12) United States Patent
Onoda et al.

(10) Patent No.: US 9,321,163 B2
(45) Date of Patent: Apr. 26, 2016

(54) IMPACT TOOL

(75) Inventors: Shinji Onoda, Anjo (JP); Kiyonobu Yoshikane, Anjo (JP); Hitoshi Iida, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 948 days.

(21) Appl. No.: 13/532,065

(22) Filed: Jun. 25, 2012

(65) Prior Publication Data

US 2013/0000937 A1 Jan. 3, 2013

(30) Foreign Application Priority Data

Jul. 1, 2011 (JP) ..... 2011-147497

(51) Int. Cl.
*B25D 17/24* (2006.01)
*B25D 11/06* (2006.01)

(52) U.S. Cl.
CPC ..... *B25D 11/062* (2013.01); *B25D 17/24* (2013.01); *B25D 2211/061* (2013.01); *B25D 2217/0088* (2013.01); *B25D 2250/245* (2013.01)

(58) Field of Classification Search
CPC ..... B25D 11/062; B25D 17/24; B25D 2250/245; B25D 2217/0088; B25D 2217/0076; B25D 2211/061; B25D 2217/008
USPC ..... 173/122, 112, 113, 114, 117, 162.1, 173/162.2
See application file for complete search history.

(56) References Cited

U.S. PATENT DOCUMENTS

| | | | | |
|---|---|---|---|---|
| 5,138,243 | A | 8/1992 | Kress et al. | |
| 6,112,830 | A * | 9/2000 | Ziegler | B25D 16/00 173/109 |
| 6,926,108 | B1 * | 8/2005 | Polakowski | B62M 27/02 180/190 |
| 7,588,097 | B2 * | 9/2009 | Kamegai et al. | 173/162.1 |
| 8,403,075 | B2 * | 3/2013 | Schlesak | B25D 11/062 173/109 |
| 2004/0222001 | A1 * | 11/2004 | Ikuta et al. | 173/210 |
| 2007/0034397 | A1 | 2/2007 | Fischer et al. | |
| 2008/0047723 | A1 | 2/2008 | Kamegai et al. | |
| 2009/0223691 | A1 | 9/2009 | Ikuta et al. | |
| 2009/0223692 | A1 | 9/2009 | Yoshikane | |
| 2009/0321101 | A1 * | 12/2009 | Furusawa et al. | 173/162.2 |

(Continued)

FOREIGN PATENT DOCUMENTS

| | | | |
|---|---|---|---|
| DE | 10 2007 061 716 | A1 | 6/2009 |
| EP | 1 000 712 | A2 | 5/2000 |

(Continued)

OTHER PUBLICATIONS

Partial Search Report issued in European Patent Application No. 12173864.5 dated Oct. 1, 2012.

(Continued)

*Primary Examiner* — Andrew M Tecco
(74) *Attorney, Agent, or Firm* — Oliff PLC

(57) ABSTRACT

An impact tool comprises a motor, a swinging member that is driven by the motor and swings in an axial direction of the tool bit, a striking mechanism that is driven in the axial direction of the tool bit by the swinging motion of the swinging member, a connecting part that connects the swinging member and the striking mechanism, a housing member that houses at least the connecting part in an internal space, and a counter weight that is disposed within the internal space of the housing member and reduces vibration caused when the tool bit is driven.

7 Claims, 6 Drawing Sheets

(56) References Cited

U.S. PATENT DOCUMENTS

| | | | | |
|---|---|---|---|---|
| 2010/0270046 | A1* | 10/2010 | Schlesak | B25D 11/062 173/109 |
| 2011/0017483 | A1* | 1/2011 | Baumann et al. | 173/162.2 |

FOREIGN PATENT DOCUMENTS

| | | | |
|---|---|---|---|
| EP | 1 892 062 | A2 | 2/2008 |
| EP | 2 103 388 | A1 | 9/2009 |
| JP | H03-131481 | A | 6/1991 |
| JP | 2007-044868 | A | 2/2007 |
| JP | A-2008-73836 | | 4/2008 |
| JP | 2009-208208 | A | 9/2009 |
| JP | 2009-208210 | A | 9/2009 |
| WO | WO 2008/010467 | A1 | 1/2008 |

OTHER PUBLICATIONS

Jan. 28, 2013 European Search Report issued in Application No. 12173864.5.

Nov. 5, 2014 Office Action issued in Application No. JP2011-147497.

Feb. 29, 2016 Office Action issued in European Patent Application No. 12173864.5.

* cited by examiner

IMPACT TOOL

BACKGROUND OF THE INVENTION

1. Field of the Invention

The present invention relates to an impact tool which performs a predetermined operation on a workpiece by striking movement of a tool bit in its axial direction.

2. Description of the Related Art

Japanese laid-open patent publication No. 2008-73836 discloses a hammer drill as an example of an impact tool in which a striking mechanism part is driven via a swinging member which swings in the axial direction of a tool bit by the rotating output of a motor and the striking mechanism part linearly drives (strikes) a tool bit. The known hammer drill includes a counter weight that reduces vibration caused when the tool bit is driven. In the known hammer drill, the counter weight is disposed between an outer housing for forming an outer shell of the hammer drill and an inner housing for holding the striking mechanism part within the outer housing. Specifically, the counter weight is disposed outside the inner housing and configured to be moved in the axial direction of the tool bit by receiving power from the swinging member and thereby reduce vibration.

In this construction in which the counter weight is disposed outside the inner housing, however, it is necessary to provide clearances between the counter weight and the inner housing and between the counter weight and the outer housing in order to avoid interference in a direction transverse to the axial direction of the tool bit. This is an impediment to size reduction of the tool body.

PRIOR ART REFERENCE

Japanese laid-open patent publication No. 2008-73836

SUMMARY OF THE INVENTION

Accordingly, it is an object of the present invention to provide an impact tool in which a tool body can be effectively reduced in size.

In order to solve the above-described problem, in a preferred embodiment according to the present invention, an impact tool which performs a predetermined operation on a workpiece by striking movement of a tool bit in an axial direction of the tool bit is provided. The impact tool has a swinging member that is driven by the motor and swings in the axial direction of the tool bit, a striking mechanism that is driven by components of linear motion in the axial direction of the tool bit in the swinging motion of the swinging member, a connecting part that connects the swinging member and the striking mechanism, a housing member that houses at least the connecting part in an internal space, and a counter weight that is disposed within the internal space of the housing member and reduces vibration caused when the tool bit is driven. The "connecting part" in this invention refers to a member for movably connecting the swinging member and a cylindrical piston which is driven by the swinging member and linearly moves, and its surrounding region. The "internal space" in this invention is preferably formed as a space which is open in part in the axial direction of the tool bit and the circumferential direction. Therefore, the counter weight disposed inside the housing member is partly exposed from the housing member.

In the construction as described above in which the counter weight is disposed inside the housing member, it is only necessary to provide a clearance between the counter weight and the housing member to avoid interference. Therefore, compared with the known construction in which the counter weight is disposed between the outer housing for forming the outer shell of the impact tool and the inner housing, the number of clearances required to avoid interference can be reduced, so that the tool body can be reduced in size.

According to a further embodiment of the present invention, the counter weight is connected to the housing member and can rotate on a pivot shaft and the counter weight is connected to the swinging member on the opposite side of a pivot of the swinging member from the connecting part.

According to this embodiment, the counter weight can be driven in a direction opposite to the direction in which the striking mechanism strikes the tool bit. Therefore, the counter weight can effectively reduce vibration caused by striking the tool bit.

According to a further embodiment of the present invention, the counter weight is formed in one piece. The method of "forming in one piece" in this invention may include sintering, cutting, forging and casting.

According to this embodiment, the counter weight having higher durability can be obtained by forming it in one piece.

According to a further embodiment of the present invention, the counter weight is formed in a closed ring-like form. The "closed ring-like form" literally refers to a structure having no opening in the circumferential direction and the shape in the circumferential direction is not particularly limited and suitably includes circular, oval and non-circular forms.

According to this embodiment, by forming the counter weight in a closed ring-like form, durability of the counter weight can be further enhanced.

According to a further embodiment of the present invention, the striking mechanism and the swinging member are assembled into an assembly via the connecting part in advance.

According to this embodiment, the striking mechanism and the swinging member which are assembled into an assembly in advance can be handled as one component part, so that ease of mounting and ease of repair can be increased.

According to a further embodiment of the present invention, a metal member is disposed between sliding surfaces of the housing member and the counter weight which rotates on the pivot shaft with respect to each other.

According to this embodiment, the sliding surfaces can be protected by the metal member. Therefore, when the housing member is formed of soft metal materials such as aluminum in order to make the tool body lighter, while the counter weight is formed of high-density sintered alloy in order to make it heavier, the metal member may be provided and configured to be fixed to the housing member and to rotate with respect to the counter weight, so that the sliding surface of the soft metal housing member can be protected from wear.

According to a further embodiment of the present invention, the housing member and the metal member have respective shaft holes through which the pivot shaft is inserted. Further, the metal member is positioned with respect to the housing member such that a center of the shaft hole of the metal member is aligned with a center of the shaft hole of the housing member.

According to this embodiment, it is not necessary to take the trouble of centering the shaft hole of the metal member with respect to the shaft hole of the housing member, so that the pivot shaft can be easily mounted.

According to a further embodiment of the present invention, the impact tool has an outer housing that is disposed outside the housing member and houses the housing member.

The housing member and the outer housing have respective fitting surfaces extending around an axis of the tool bit, and an O-ring is disposed between the fitting surfaces and extends in the circumferential direction. The O-ring is arranged to be partially displaced (skewed) in the axial direction of the hammer bit.

According to this embodiment, when a clearance between the fitting surfaces of the housing member and the outer housing in the circumferential direction is sealed by the O-ring in order to prevent leakage of lubricant sealed in the outer housing, the O-ring can be arranged to be displaced (inclined) in the axial direction of the tool bit with respect to a transverse plane transverse to the axial direction of the tool bit 119. Thus, a sealing surface can be selected to avoid an inadequate region in terms of shape as the sealing surface.

Effect Of The Invention

According to this invention, an impact tool in which a tool body can be effectively reduced in size is provided. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
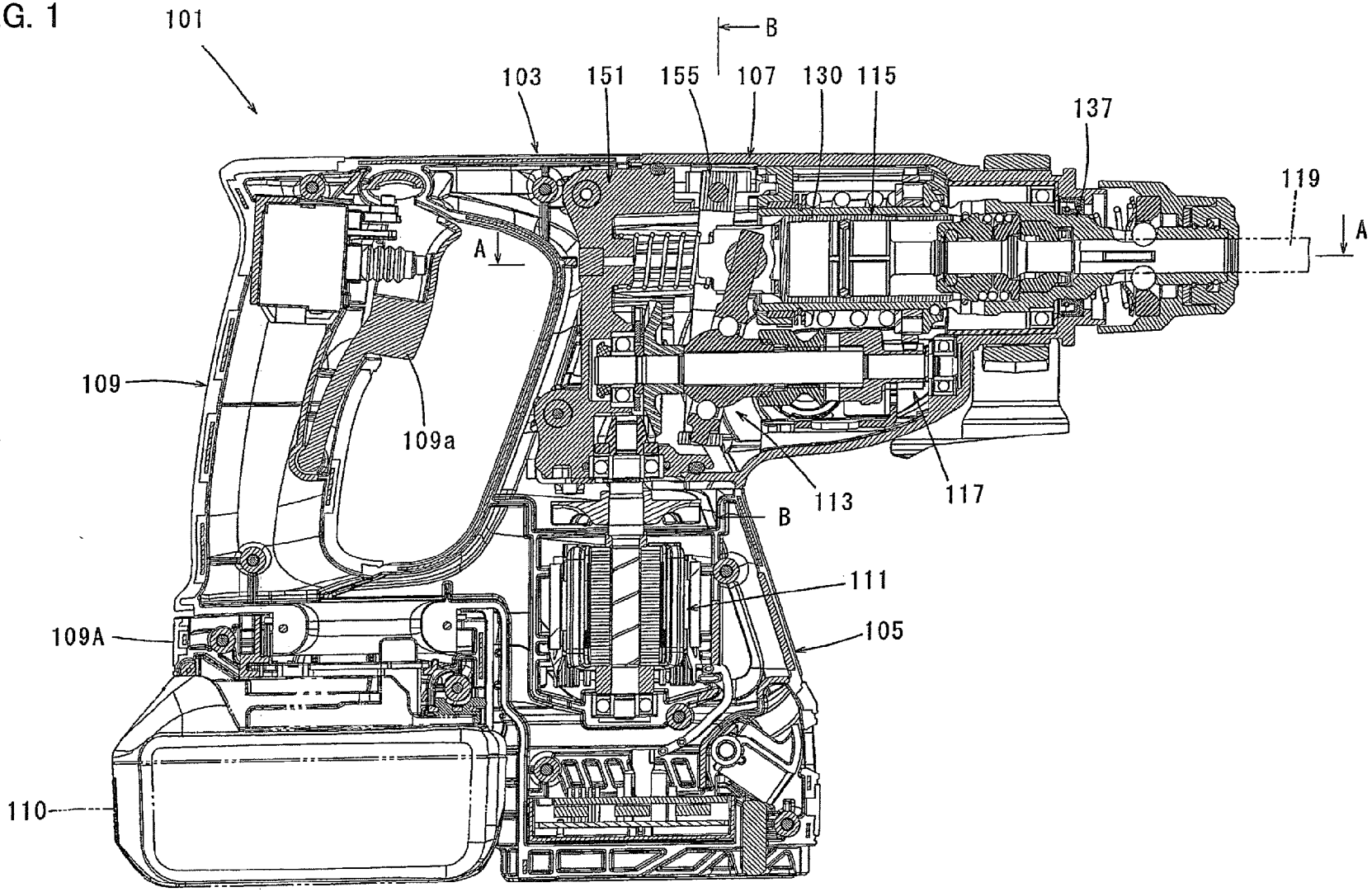
FIG. 1 is a sectional view showing an entire structure of a hammer drill according to an embodiment of the invention.

A first embodiment of the present invention is now described with reference to FIGS. 1 to 7. In this embodiment, a battery-powered hammer drill is explained as a representative example of an impact tool according to the present invention. As shown in FIG. 1, a hammer drill 101 of this embodiment mainly includes a tool body in the form of a body 103 that forms an outer shell of the hammer drill 101, a hammer bit 119 detachably coupled to a front end region (on the right as viewed in FIG. 1) of the body 103 via a tool holder 137, and a handgrip 109 connected to the body 103 on the side opposite to the hammer bit 119. The hammer bit 119 is a feature that corresponds to the "tool bit" according to the present invention. The handgrip 109 is designed and provided as a main handle to be held by a user. The hammer bit 119 is held by the tool holder 137 such that it is allowed to reciprocate in its axial direction with respect to the tool holder 137 and prevented from rotating in its circumferential direction with respect to the tool holder. In this embodiment, for the sake of convenience of explanation, in a horizontal position of the body 103 in which the axial direction of the hammer bit 119 coincides with a horizontal direction, the hammer bit 119 side is taken as the front and the handgrip 109 side as the rear.

The body 103 mainly includes a motor housing 105 that houses a driving motor 111, and a gear housing 107 that houses a motion converting mechanism 113, a striking mechanism 115 and a power transmitting mechanism 117. The driving motor 111 and the gear housing 107 are features that correspond to the "motor" and the "outer housing", respectively, according to this invention. The handgrip 109 extends in a vertical direction transverse to the axial direction of the hammer bit 119 and is configured as a closed loop (D-shaped) handle having upper and lower ends connected to the body 103. A battery mounting part 109A is formed on a lower end of the handgrip 109 and a rechargeable battery pack 110 from which the driving motor 111 is powered is detachably mounted on the battery mounting part 109A.

Figure 2:
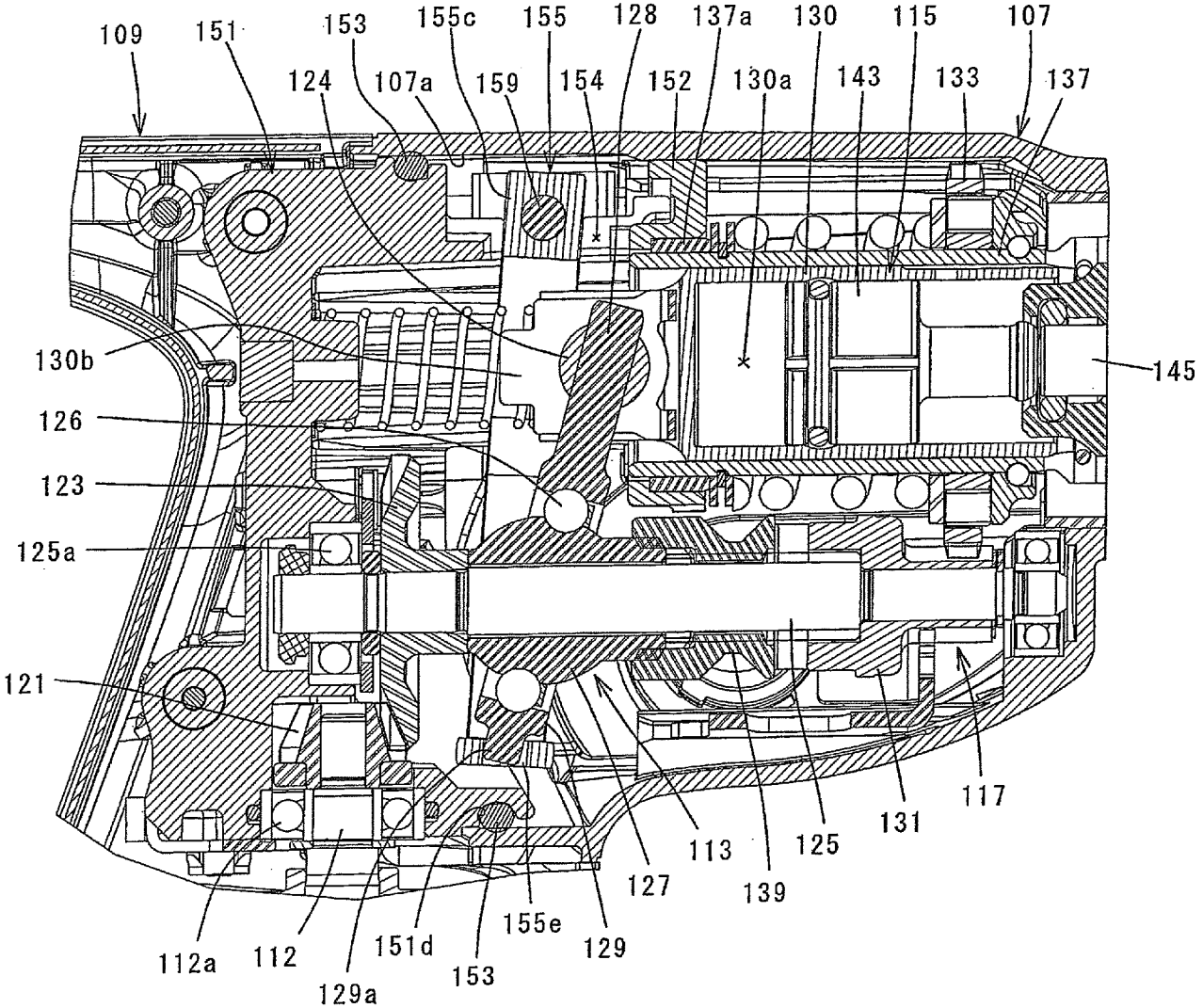
FIG. 2 is a partly enlarged view of FIG. 1.

FIG. 2 is an enlarged sectional view showing the motion converting mechanism 113, the striking mechanism 115 and the power transmitting mechanism 117. The motion converting mechanism 113 appropriately converts a rotating output of the driving motor 111 into linear motion and then transmits it to the striking mechanism 115. Then, an impact force is generated in the axial direction of the hammer bit 119 via the striking mechanism 115. Further, the power transmitting mechanism 117 appropriately reduces the speed of the rotating output of the driving motor 111 and transmits it to the hammer bit 119 as a rotating force, so that the hammer bit 119 is caused to rotate in the circumferential direction. The driving motor 111 is arranged below the axis of the hammer bit 119 such that the axis of the output shaft 112 extends in a direction transverse to the axial direction of the hammer bit 119. The driving motor 111 is driven when a motor operating member in the form of a trigger 109*a* (see FIG. 1) on the handgrip 109 is depressed by the user.

The motion converting mechanism 113 mainly includes a driving gear 121, a driven gear 123, an intermediate shaft 125, a rotating element 127 and a swinging ring 129. The driving gear 121 is a small bevel gear which is fitted on an output shaft 112 of the driving motor 111 extending in a vertical direction transverse to the axial direction of the hammer bit 119 and is rotated in a horizontal plane by the driving motor. The driven gear 123 is a large bevel gear which engages with the driving gear 121 and rotates together with the intermediate shaft 125 which is disposed in parallel to the axial direction of the hammer bit 119. The rotating element 127 rotates together with the intermediate shaft 125, and the swinging ring 129 is rotatably mounted on the outer periphery of the rotating element 127 via a bearing 126. The swinging ring 129 is provided and configured as a swinging member which is caused to swing in the axial direction of the hammer bit 119 by rotation of the rotating element 127. The swinging ring 129 has a swinging rod 128 extending upward therefrom in a direction transverse to the axial direction of the hammer bit 119. The swinging rod 128 is rotatably connected to a rear end (bottom) of the cylindrical piston 130 having a bottom via a cylindrical connecting shaft 124. The swinging ring 129 is a feature that corresponds to the "swinging member" according to the present invention.

A U-shaped connecting part (crevice) 130*b* which is generally U-shaped in plan view is integrally formed on a rear end (left end as viewed in FIG. 2) of the cylindrical piston 130 and connected to the swinging rod 128 of the swinging ring 129 via the connecting shaft 124. The connecting shaft 124 is provided and configured as a connecting member for connecting the cylindrical piston 130 and the swinging ring 129. The connecting shaft 124 is mounted such that it can rotate around a horizontal axis extending in a direction transverse to the axial direction of the hammer bit 119 with respect to the U-shaped connecting part 130*b* and it can rotate around a vertical axis extending in a direction transverse to the axial direction of the hammer bit 119 with respect to the swinging rod 128. With such a construction, in the swinging movement of the swinging ring 129, components of linear motion in the axial direction of the hammer bit 119 is transmitted to the cylindrical piston 130, so that the cylindrical piston 130 can be linearly moved. The connecting shaft 124 is a feature that corresponds to the "connecting part" according to the present invention.

The striking mechanism 115 mainly includes a driving element in the form of the cylindrical piston 130 having a bottom, a striking element in the form of a striker 143 that is slidably disposed within the bore of the cylindrical piston 130, and an intermediate element in the form of an impact bolt 145 that is slidably disposed within the tool holder 137. The striker 143 is driven by the action of an air spring (pressure fluctuations) within an air chamber 130*a* of the cylindrical piston 130 which is caused by the sliding movement of the cylindrical piston 130. The striker 143 then collides with (strikes) the impact bolt 145 and transmits the impact (striking) force caused by the collision to the hammer bit 119. The striking mechanism 115 is a feature that corresponds to the "striking mechanism" according to the present invention.

The power transmitting mechanism 117 mainly includes a first transmission gear 131 that is mounted on the intermediate shaft 125 on the opposite side of the swinging ring 129 from the driven gear 123, a second transmission gear 133 that engages with the first transmission gear 131 and is caused to rotate around the axis of the hammer bit 119, and a final shaft in the form of the tool holder 137 that is caused to rotate around the axis of the hammer bit 119 together with the coaxially-mounted second transmission gear 133. The rotating output of the intermediate shaft 125 which is rotationally driven by the driving motor 111 is transmitted from the first transmission gear 131 to the hammer bit 119 held by the tool holder 137 via the second transmission gear 133. The tool holder 137 is generally cylindrical and held by the gear housing 107 such that it can rotate around the axis of the hammer bit 119. The tool holder 137 has a front cylindrical part which houses and holds a shank of the hammer bit 119 and the impact bolt 145 and a rear cylindrical part which extends rearward from the front cylindrical part and houses and holds the cylindrical piston 130 such that the piston can slide therein.

In the hammer drill 101 constructed as described above, when the driving motor 111 is driven by a user's depressing operation of the trigger 109*a* and the intermediate shaft 125 is rotationally driven, the cylindrical piston 130 is caused to linearly slide within the tool holder 137 by the swinging movement of the swinging ring 129. The striker 143 is caused to reciprocate within the cylindrical piston 130 by air pressure fluctuations or the action of an air spring within the air chamber 130*a* of the cylindrical piston 130 which is caused by the sliding movement of the cylindrical piston 130. The striker 143 then collides with the impact bolt 145 and transmits the kinetic energy caused by the collision to the hammer bit 119.

When the first transmission gear 131 is caused to rotate together with the intellnediate shaft 125, the tool holder 137 is caused to rotate in a vertical plane via the second transmission gear 133 engaged with the first transmission gear 131, which in turn causes the hammer bit 119 held by the tool holder 137 to rotate together with the tool holder 137. Thus, the hammer bit 119 performs a hammering movement in the axial direction and a drilling movement in the circumferential direction, so that a drilling operation is performed on a workpiece (concrete).

Further, the hammer drill 101 according to this embodiment has a mode switching clutch 139 for switching not only to hammer drill mode in which the hammer bit 119 performs hammering movement and drilling movement in the circumferential direction, but also to drilling mode in which the hammer bit 119 performs only drilling movement. The mode switching clutch 139 is spline-fitted on the intermediate shaft 125 such that it can move in the axial direction. The mode switching clutch 139 can be moved in the axial direction by external manual operation such that it is switched between a power transmission state in which clutch teeth of the mode switching clutch 139 are engaged with clutch teeth of the rotating element 127 and rotation of the intermediate shaft 125 is transmitted to the rotating element 127, and a power transmission interrupted state in which the clutch teeth are disengaged and power transmission is interrupted. The hammer drill mode can be selected by switching to the power transmission state, and the drill mode can be selected by switching to the power transmission interrupted state.

The hammer drill 101 has a vibration reducing mechanism for reducing impulsive and cyclic vibration caused in the axial direction of the hammer bit 119 or the direction of axis of striking motion. The vibration reducing mechanism according to this embodiment mainly includes a counter weight 155 which is driven by the swinging ring 129. The counter weight 155 is a feature that corresponds to the "counter weight" according to the present invention.

Figure 4:
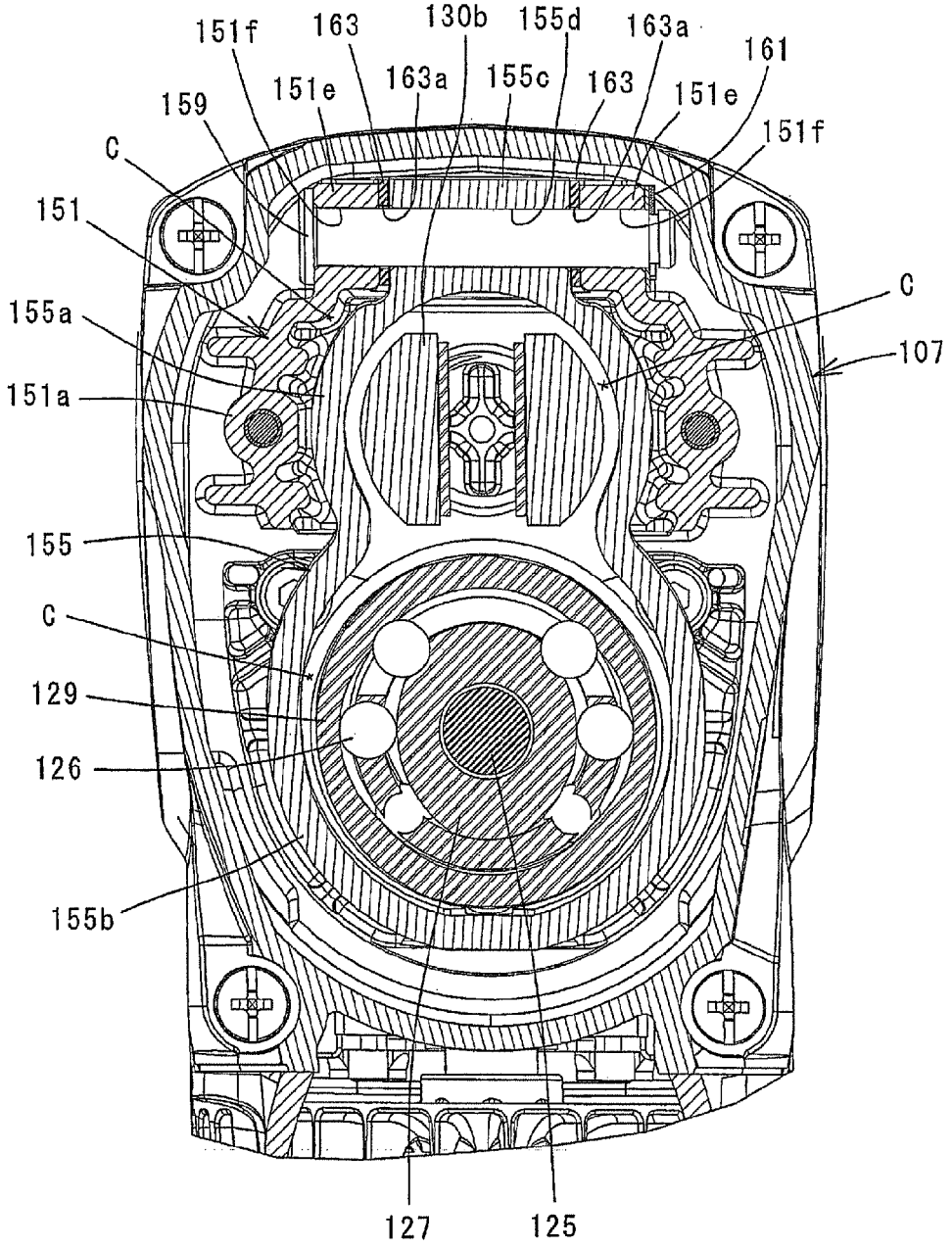
FIG. 4 is a sectional view taken along line B-B in FIG. 1.

As shown in FIG. 4, the counter weight 155 is a generally pear-shaped ring when viewed from the axial direction of the hammer bit 119 and disposed inside of an inner housing 151 mounted within the rear of the gear housing 107. The inner housing 151 is a feature that corresponds to the "housing member" according to the present invention. As shown in FIG. 2, the inner housing 151 rotatably holds the output shaft 112 of the driving motor 111, the intermediate shaft 125 and the rear end of the tool holder 137, and the inner housing 151 covers the driving gear 121, the driven gear 123 and the connecting region (the U-shaped connecting part 130*b*, the swinging rod 128 and the connecting shaft 124) between the swinging ring 129 and the cylindrical piston 130.

Figure 5:
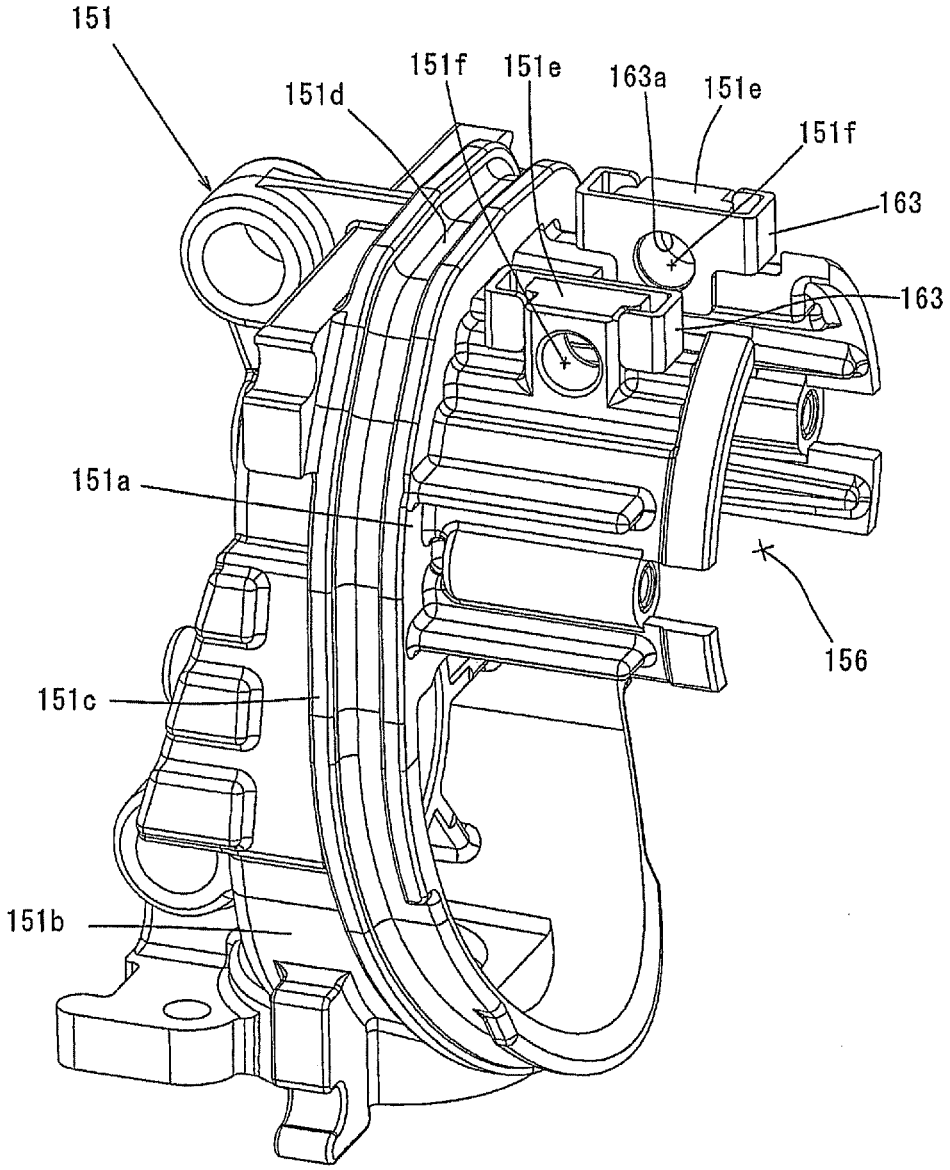
FIG. 5 is a perspective view showing an inner housing.

As shown in FIG. 5, the inner housing 151 has a generally inverted-L form in side view, having an open front and further having open right and left sides and an open bottom in a lower half of its front region. An upper half 151*a* of the inner housing 151 is configured and provided as a region for rotatably holding the outer periphery of a rear end portion of the tool holder 137 via a bearing 137*a* (see FIGS. 2 and 3) and housing the connecting region between the swinging ring 129 and the cylindrical piston 130. A lower half 151*b* of the inner housing 151 is configured and provided as a region for rotatably holding an upper end of the output shaft 112 and a rear end of the intermediate shaft 125 via bearings 112*a*, 125*a* (see FIG. 2) and housing the driving gear 121 and the driven gear 123. Further, a region of the upper half 151*a* which holds the rear end (the bearing 137*a*) is separately formed as a closed ring-shaped tool holder holding part 152.

The inner housing 151 is fitted into a rear opening 107*a* (see FIG. 2) of the gear housing 107 from the rear. An O-ring 153 is disposed between an outer circumferential fitting surface 151*c* (see FIG. 5) of the inner housing 151 and an inner circumferential fitting surface of the rear opening 107*a* of the gear housing 107. The O-ring 153 is fitted in a circumferential O-ring mounting groove 151 d formed in the outer circumferential fitting surface 151*c* of the inner housing 151 and held in close contact with the inner circumferential fitting surface of the rear opening 107*a* of the gear housing 107. With such a construction, lubricant (grease), which is filled into the gear housing 107 in order to lubricate driving mechanisms such as the motion converting mechanism 113, the striking mechanism 115 and the power transmitting mechanism 117 within the gear housing 107, can be prevented from leaking to the outside.

Further, as shown in FIG. 2, the outer circumferential fitting surface 151*c* of the inner housing 151 and the O-ring 153 are arranged such that their lower end portions are inclined forward with respect to a transverse plane (vertical plane) transverse to the axial direction of the hammer bit 119. Thus, the O-ring 153 is arranged to be partially displaced (placed in different positions, skewed) in the axial direction of the hammer bit 119. With such a construction, when the inner housing 151 has an inadequate region in terms of shape as a sealing surface on the same vertical plane, the sealing surface can be selected to avoid this region. In this embodiment, for reasons of design, the open end surface of the rear opening 107*a* of the gear housing 107 is configured to be inclined forward, and such design can be suitably matched with the above-described construction.

Figure 3:
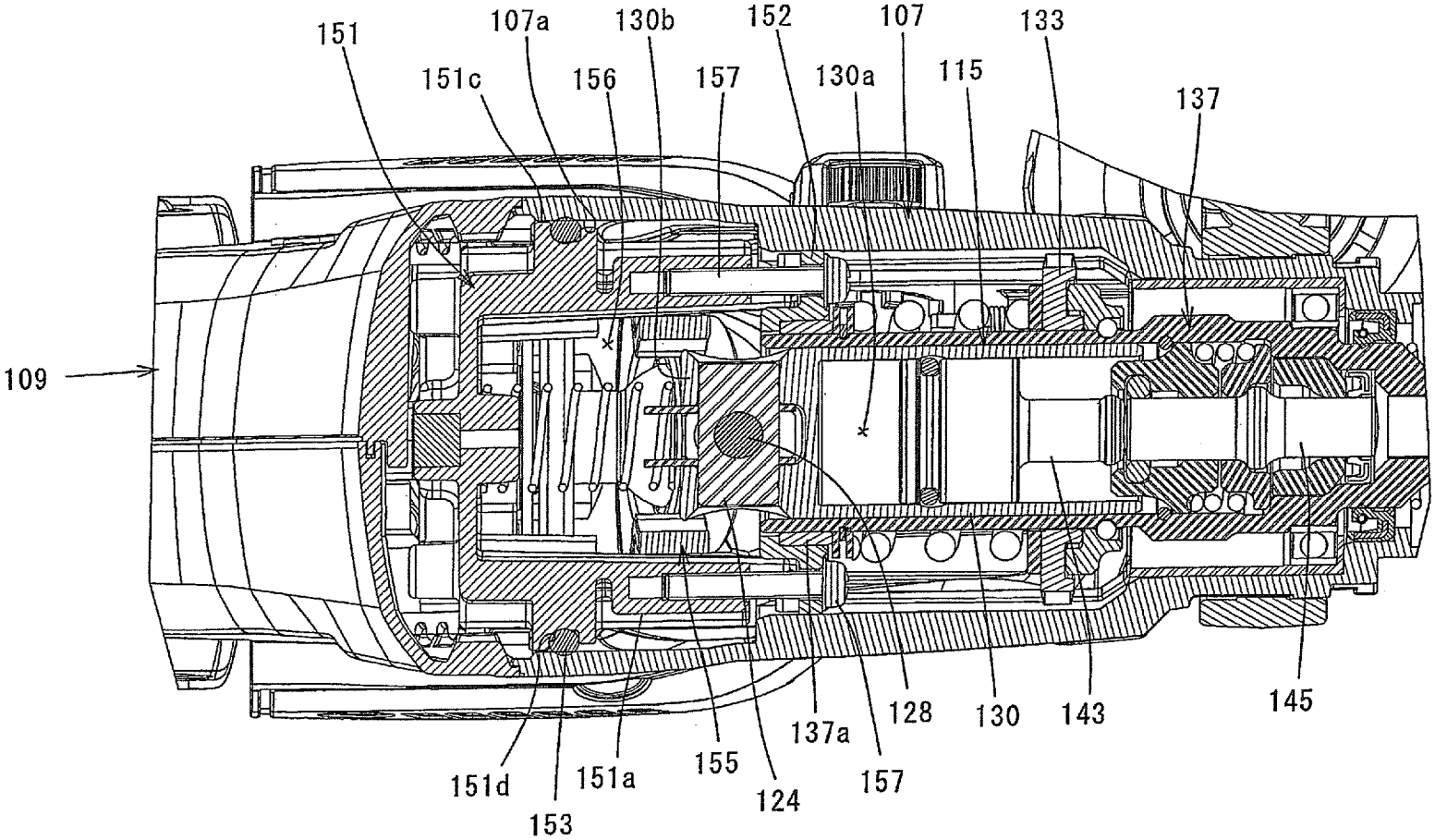
FIG. 3 is a sectional view taken along line A-A in FIG. 1.

As shown in FIG. 4, the counter weight 155 is formed in one piece as a generally pear-shaped, closed ring-like member having two annular parts 155*a*, 155*b* integrally connected in the vertical direction (radial direction), by sintering, cutting, forging, casting or other similar methods. The counter weight 155 is moved rearward (leftward as viewed in FIG. 4) in the axial direction of the hammer bit 119 to be installed inside the inner housing 151. At this time, on the upper half 151*a* side of the inner housing 151, the upper annular part 155*a* of the counter weight 155 is placed around the connecting region (the U-shaped connecting part 130*b*) between the swinging ring 129 and the cylindrical piston 130, and on the lower half 151*b* side of the inner housing 151, the lower annular part 155*b* is placed around the swinging ring 129. Such arrangement of the counter weight 155 in the inner housing 151 can be realized by forming the annular tool holder holding part 152 separate from the upper half 151*a* of the inner housing 151 as described above. Specifically, after the counter weight 155 is placed within the inner housing 151, as shown in FIG. 3, the tool holder holding part 152 is abutted against the open front end surface of the upper half 151*a* of the inner housing 151 and fastened by right and left fixing screws 157. With this construction, the counter weight 155 can be installed inside the inner housing 151.

As shown in FIG. 4, the upper annular part 155*a* of the counter weight 155 is covered by the upper half 151*a* of the inner housing 151, but the lower annular part 155*b* of the counter weight 155 is exposed from the lower half 151*b* of the inner housing 151 due to the configuration of the lower half 151*b* having the open right and left sides and bottom as described above. This open form of the lower half 151*b* is effective in weight reduction of the inner housing 151. Specifically, the upper annular part 155*a* which forms part of the counter weight 155 is housed by the upper half 151*a* of the inner housing 151, and an internal space 156 (see FIGS. 3 and 5) surrounded by the upper half 151*a* is a feature that corresponds to the "internal space" according to the present invention.

As shown in FIG. 4, an upwardly protruding rectangular mounting part 155*c* is formed on the upper end of the upper annular part 155*a* of the counter weight 155 housed in the upper half 151*a* of the inner housing 151. The mounting part 155*c* is loosely disposed in an opening 154 (see FIG. 2) formed in an upper region of the upper half 151*a* of the inner housing 151 and mounted to the upper half 151*a* by a mounting pin 159 with a head. Specifically, the counter weight 155 is mounted to the inner housing 151 above the axis of striking motion of the hammer bit 119 such that it can rotate on the mounting pin 159 in the axial direction of the hammer bit 119 (front-back direction). The mounting pin 159 is a feature that corresponds to the "pivot shaft" according to the present invention.

As shown in FIG. 2, an engagement hole 155*e* is formed in a lower end of the lower annular part 155*b* of the counter weight 155, and a radially protruding, columnar or cylindrical projection 129*a* is correspondingly formed as an engagement part in a lower end region of the swinging ring 129, or in a position displaced about 180 degrees in the circumferential direction from the connecting part between the swinging ring 129 and the piston 130. The projection 129*a* is movably engaged in the engagement hole 155*e* of the counter weight 155. Therefore, when the swinging ring 129 swings, the counter weight 155 is driven with the mounting pin 159 as a pivot by swinging of the swinging ring 129 and rotates in the opposite direction with respect to the linear motion of the piston 130. Further, as shown in FIG. 4, a clearance C is formed between the outer surface of the counter weight 155 and the inner wall of the inner housing 151 and between the inner surface of the counter weight 155 and the opposed outer surface of the U-shaped connecting part 130*b* and the outer surface of the swinging ring 129 in order to avoid interference therebetween during rotation of the counter weight 155.

As shown in FIG. 4, the mounting pin 159 is loosely inserted through pin holes 151*f* of right and left pin holding parts 151*e* formed on opposite sides of the opening 154 in the upper half 151*a* of the inner housing 151 and through a pin hole 155*d* of the mounting part 155*c* of the counter weight 155 which is disposed in the opening 154. Further, a stopper ring 161 is mounted on the tip of the mounting pin 159 to prevent it from becoming removed. The inner housing 151 is formed of lightweight metal materials such as aluminum in order to make the tool body lighter. In the case of aluminum, however, the siding part is susceptible to wear. In this embodiment, therefore, an iron sheet intervening member 163 with a pin hole is disposed between opposed sliding surfaces of the mounting part 155*c* of the counter weight 155 and the pin holding parts 151*e* of the inner housing 151 in order to protect the inner housing 151 from wear. The intervening member 163 and the pin holes 151*f*, 155*d* are features that correspond to the "metal member" and the "shaft hole", respectively, according to the present invention.

As shown in FIG. 5, the intervening member 163 is formed by bending an iron sheet into a generally C shape in plan view. The intervening member 163 is fitted onto each of the right and left pin holding parts 151*e* from above such that its vertical side having a pin hole 163*a* is disposed between the pin holding part 151*e* and the mounting part 155*c* of the counter weight 155 (see FIG. 4). When the intervening member 163 is fitted on the pin holding part 151*e*, the intervening member 163 is positioned in the vertical direction by contact of a lower end surface of the intervening member 163 with the upper surface of the upper half 151*a* and also positioned in the transverse direction by contact of ends of the C shape of the intervening member 163 with the side of the pin holding part 151*e*. At this time, the center of the pin hole 163*a* of the intervening member 163 is aligned with the center of the pin hole 151*f* of the pin holding part 151*e*. Therefore, it is not necessary to take the trouble of centering the pin hole 163 a of the intervening member 163 with respect to the pin hole 151*f* of the pin holding part 151*e*. Thus, the mounting part 155*c* of the counter weight 155 can be easily mounted to the pin holding parts 151*e* of the inner housing 151 by the mounting pin 159.

Figure 6:
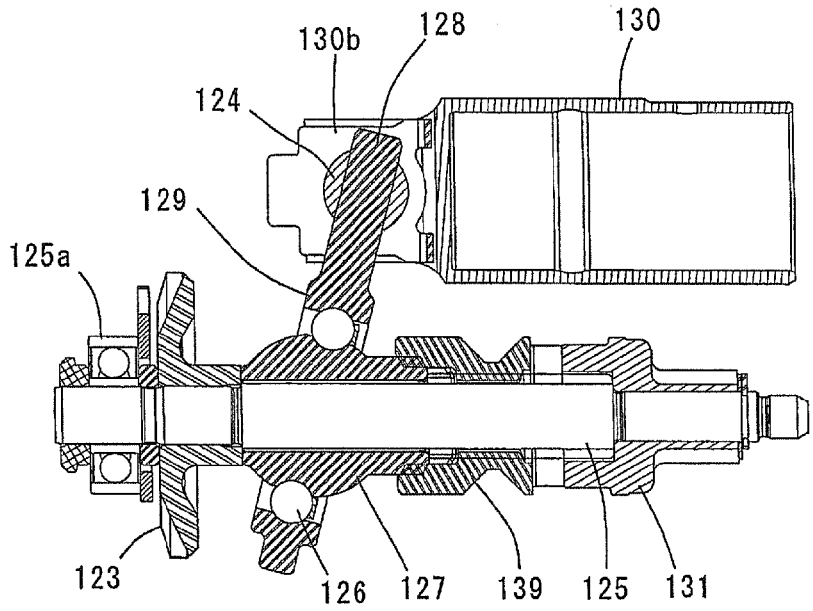
FIG. 6 is a sectional view showing an assembly including a cylindrical piston and a swinging ring.

In this embodiment, as shown in FIG. 6, the intermediate shaft 125 which is a second shaft in the power transmission system and the cylindrical piston 130 which is a component of the striking mechanism 115 are assembled into an assembly in advance, and this assembly is mounted to the inner housing 151. Specifically, the assembly is formed by mounting the bearing 125*a*, the driven gear 123, the rotating element 127, the mode switching clutch 139, the first transmission gear 131 and the swinging ring 129 onto the intermediate shaft 125 one after another and then mounting the U-shaped connecting part 130*b* of the cylindrical piston 130 to the swinging rod 128 of the swinging ring 129 via the connecting shaft 124.

Figure 7:
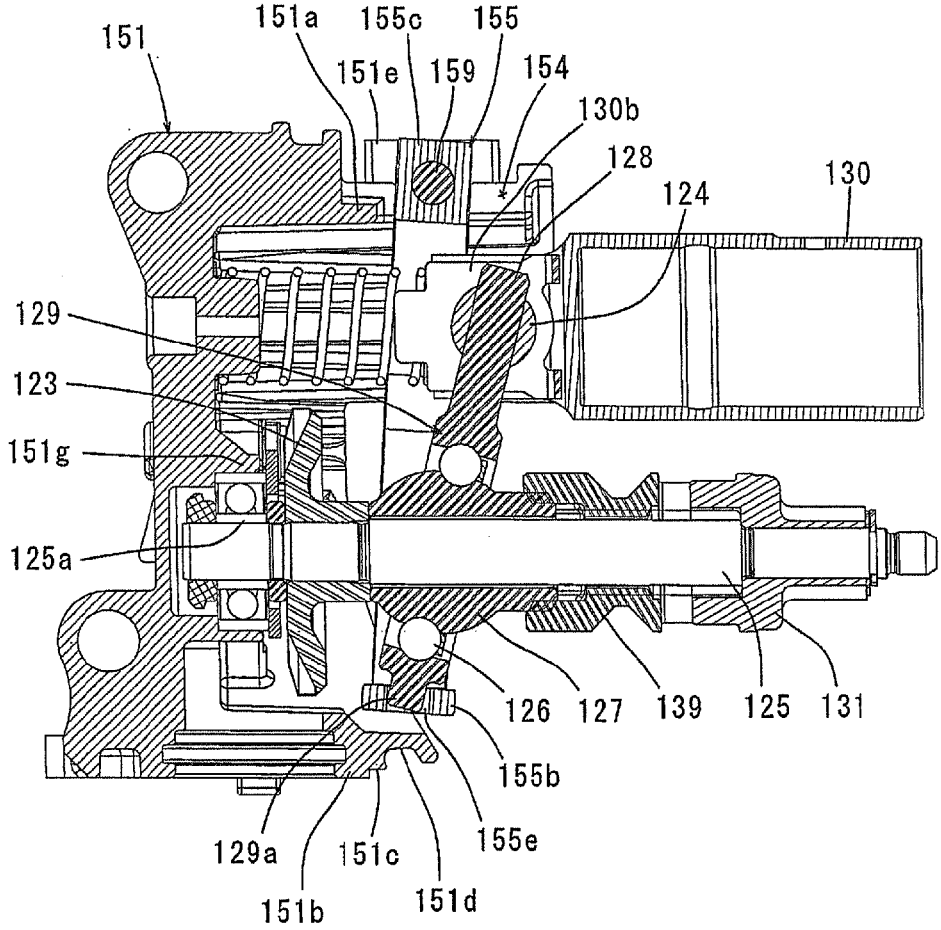
FIG. 7 is a sectional view showing the assembly mounted to the inner housing.

As shown in FIG. 7, the above-described assembly is then mounted to the inner housing 151 having the counter weight 155 mounted thereto in advance, by press-fitting an outer ring of the bearing 125*a* into a bearing housing part 151*g* of the inner housing 151. In this assembling, the projection 129*a* of the swinging ring 129 is engaged in the engagement hole 155*e* of the counter weight 155. Thereafter, the annular tool holder holding part 152 is fastened to the upper half 151*a* of the inner housing 151 by the fixing screws 157, which is not shown in FIG. 7. The assembly mounted to the inner housing 151 as described above is inserted and housed in the gear housing 107 through the rear opening 107*a* when the inner housing 151 is mounted to the gear housing 107.

In the hammer drill 101 constructed as described above, the counter weight 155 has a vibration reducing function of reducing impulsive and cyclic vibration caused in the axial direction of the hammer bit 119 during operation. The counter weight 155 is connected to the swinging ring 129 at a position displaced about 180 degrees in the circumferential direction from the connecting shaft 124 which connects the swinging ring 129 and the piston 130. Specifically, the counter weight 155 is connected to the swinging ring 129 on the opposite side of the pivot of the swinging ring 129 from the connecting shaft 124. Therefore, when the piston 130 slides toward the striker 143 within the tool holder 137, the counter weight 155 rotates in a direction opposite to the sliding direction of the striker 143, so that vibration caused in the hammer drill 101 is reduced in the axial direction of the hammer bit 119.

In this embodiment, the counter weight 155 is disposed inside the inner housing 151. With this construction, compared with a construction in which the counter weight 155 is disposed outside the inner housing 151 (between the inner housing 151 and the gear housing 107), for example, it is not necessary to provide a clearance between the inner housing 151 and the gear housing 107, so that the body 103 can be reduced in size in its radial direction (transverse to the axial direction of the hammer bit). Specifically, in the construction in which the counter weight 155 is disposed outside the inner housing 151, it is necessary to provide clearances between the counter weight 155 and the inner housing 151 and the gear housing 107 to avoid interference. According to this embodiment, however, it is only necessary to provide a clearance between the counter weight 155 and the inner housing 151 to avoid interference. Thus, the number of clearances required to avoid interference can be reduced, so that the body 103 can be effectively reduced in size.

In this embodiment, the annular region of the inner housing for holding the tool holder 137 is formed as the annular tool holder holding part 152 separate from the inner housing 151, and can be mounted to the inner housing 151 after the counter weight 155 is mounted inside the inner housing 151. Therefore, the counter weight 155 can be mounted inside the inner housing 151 simply by moving the counter weight 155 in the axial direction of the hammer bit 119 without need of deforming. Therefore, the counter weight 155 can be formed in one piece having a closed ring-like form, by sintering, cutting, forging or other similar methods, so that the counter weight 155 having higher durability can be obtained.

According to this embodiment, the swinging ring 129 on the intermediate shaft 125 and the cylindrical piston 130 are assembled into an assembly in advance, and this assembly is mounted to the inner housing 151. By forming such an assembly, all components relating to power transmission from the intermediate shaft 125 to the cylindrical piston 130 can be handled as one component part, so that ease of mounting and ease of repair can be increased.

According to this embodiment, the iron sheet intervening member 163 is disposed between the sliding surfaces of the mounting part 155*c* of the counter weight 155 and the pin holding part 151*e* of the inner housing 151 and fixed to the pin holding part 151*e* in order to protect the sliding surfaces of the pin holding parts 151*e* from wear. Therefore, the inner housing 151 can be formed of lightweight metal such as aluminum in order to make the tool body 103 lighter.

Further, according to this embodiment, when the intervening member 163 is fitted onto the pin holding part 151*e* from above, the intervening member 163 is positioned in the vertical direction and in the transverse direction such that the center of the pin hole 163*a* of the intervening member 163 is aligned with the center of the pin hole 151*f* of the pin holding part 151*e*. Therefore, when the mounting part 155*c* of the counter weight 155 is mounted to the pin holding parts 151*e* of the inner housing 151 by the mounting pin 159, it is not necessary to take the trouble of centering the pin hole 163*a* of the intervening member 163 with respect to the pin hole 151*f* of the pin holding part 151*e*. Thus, the ease of mounting can be increased.

Further, in this embodiment, the electric hammer drill 101 is explained as a representative example of the impact tool according to the present invention, but the present invention can also be applied to an electric hammer in which the hammer bit 119 performs only striking movement in the axial direction.

DESCRIPTION OF NUMERALS

101 hammer drill (impact tool)
103 body
105 motor housing
107 gear housing
107*a* rear opening
109 handgrip
109*a* trigger
109A battery mounting part
110 battery pack
111 driving motor
112 output shaft
112*a* bearing

113 motion converting mechanism
115 striking mechanism
117 power transmitting mechanism
119 hammer bit (tool bit)
121 driving gear
123 driven gear
124 connecting shaft
125 intermediate shaft
125*a* bearing
126 bearing
127 rotating element
128 swinging rod
129 swinging ring (swinging member)
129*a* projection
130 cylindrical piston
130*a* air chamber
130*b* U-shaped connecting part
131 first transmission gear
133 second transmission gear
137 tool holder
137*a* bearing
139 mode switching clutch
143 striker
145 impact bolt
151 inner housing (housing member)
151*a* upper half
151*b* lower half
151*c* outer circumferential fitting surface
151*d* O-ring mounting groove
151*e* pin holding part
151*f* pin hole
151*g* bearing housing part
152 tool holder holding part
153 O-ring
154 opening
155 counter weight
155*a* upper annular part
155*b* lower annular part
155*c* mounting part
155*d* pin hole
155*e* engagement hole
157 fixing screw
159 mounting pin with head (pivot shaft)
161 stopper ring
163 intervening member (metal member)
163*a* pin hole

What we claim is:

1. An impact tool which is configured to perform a predetermined operation on a workpiece by striking movement of a tool bit in an axial direction of the tool bit, comprising:

a motor, a swinging member that is driven by the motor and swings in the axial direction of the tool bit, a striking mechanism that is driven linearly in the axial direction of the tool bit by the swinging motion of the swinging member, a connecting part that connects the swinging member and the striking mechanism, a housing member that houses at least the connecting part in an internal space, a counter weight that is disposed within the internal space of the housing member and reduces vibration caused when the tool bit is driven, and an outer housing that is disposed outside the housing member and houses an entirety of the housing member, wherein the counter weight has a close ring shape, and has a first annular part and a second annular part connected in a vertical direction, the first annular part being located above the second annular part in the vertical direction, the counter weight is rotatably supported by the housing member at a position above The first annular part in the vertical direction, and an entirety of the first annular part is the enclosed by the housing member.

2. The impact tool as defined in claim 1, wherein the counter weight is connected to the housing member and can rotate on a pivot shaft and the counter weight is connected to the swinging member on an opposite side of a pivot of the swinging member from the connecting part.

3. The impact tool as defined in claim 2, wherein a metal member is disposed between sliding surfaces of the housing member and the counter weight which rotate on the pivot shaft with respect to each other.

4. The impact tool as defined in claim 3, wherein the housing member and the metal member have respective shaft holes through which the pivot shaft is inserted, and the metal member is positioned with respect to the housing member such that a center of the shaft hole of the metal member is aligned with a center of the shaft hole of the housing member.

5. The impact tool as defined in claim 1, wherein the counter weight is formed in one piece.

6. The impact tool as defined in claim 1, wherein the striking mechanism and the swinging member are assembled into an assembly via the connecting part in advance.

7. The impact tool as defined in claim 1, wherein the housing member and the outer housing have respective fitting surfaces extending around an axis of the tool bit, and an O-ring is disposed between the fitting surfaces and extends in a circumferential direction, and the O-ring is arranged to be partially displaced in the axial direction of the tool bit.

* * * * *